United States Patent [19]

Marquis

[11] 3,997,742

[45] Dec. 14, 1976

[54] AUTOMATIC TIMER SWITCH

[75] Inventor: Edgar E. Marquis, Newtown, Conn.

[73] Assignee: Robertshaw Controls Company, Richmond, Va.

[22] Filed: Mar. 14, 1975

[21] Appl. No.: 558,608

[52] U.S. Cl. ..... 200/38 FB; 200/38 D

[51] Int. Cl.[2] ..... H01H 43/10; H01H 7/08

[58] Field of Search ..... 200/33–39

[56] References Cited

UNITED STATES PATENTS

| | | | |
|---|---|---|---|
| 3,254,166 | 5/1966 | Rulseh et al. | 200/38 FB |
| 3,260,807 | 7/1966 | Rulseh et al. | 200/38 FB |
| 3,497,645 | 2/1970 | Rulseh et al. | 200/38 FB |
| 3,522,393 | 7/1970 | Banathy et al. | 200/38 FB |
| 3,548,125 | 12/1970 | Banathy et al. | 200/38 D |
| 3,584,166 | 6/1971 | Halicho | 200/38 FB |
| 3,588,394 | 6/1971 | Koch | 200/38 FB X |
| 3,728,500 | 4/1973 | Ingram | 200/38 FB |
| 3,754,107 | 8/1973 | Balchunas | 200/38 FB X |

*Primary Examiner*—James R. Scott
*Attorney, Agent, or Firm*—O'Brien & Marks

[57] ABSTRACT

A timer switch includes a snap acting switch blade moved by an operating member which is biased against a side of a guideway which has inclined camming surface portions for camming the operating member under the bias force to respective opposite ends of the guideway.

15 Claims, 4 Drawing Figures

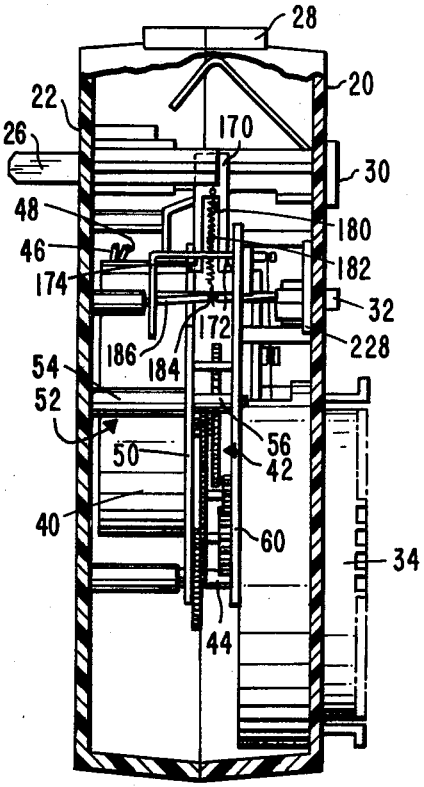
FIG. 2
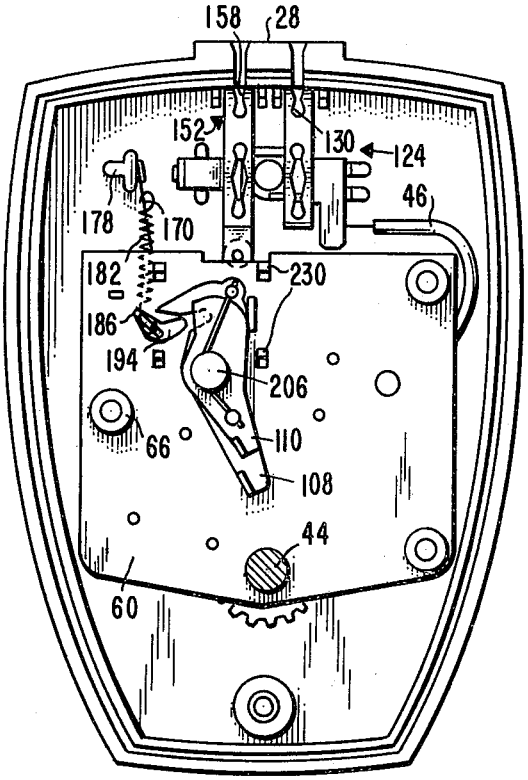
FIG. 3
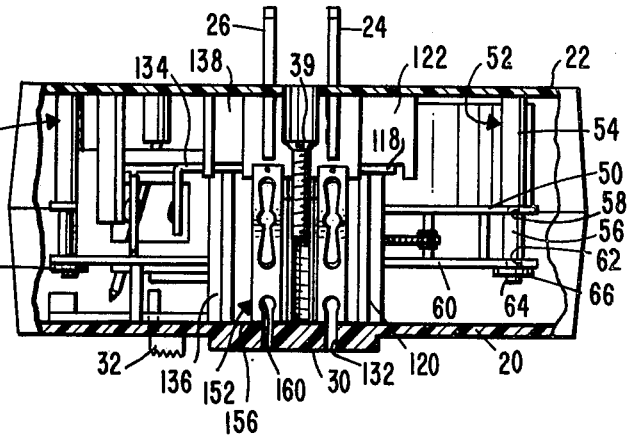
FIG. 4
FIG. 5
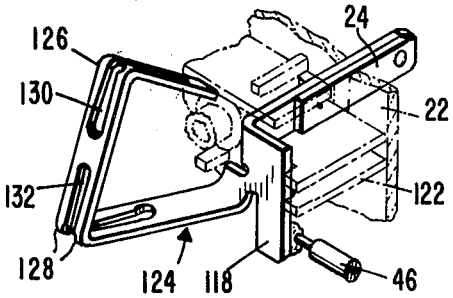
FIG. 6
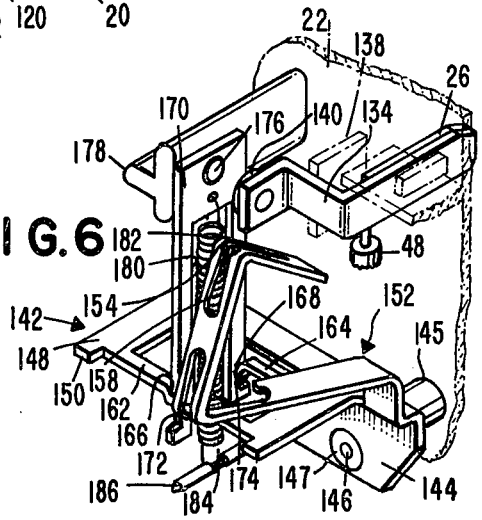

FIG. 7
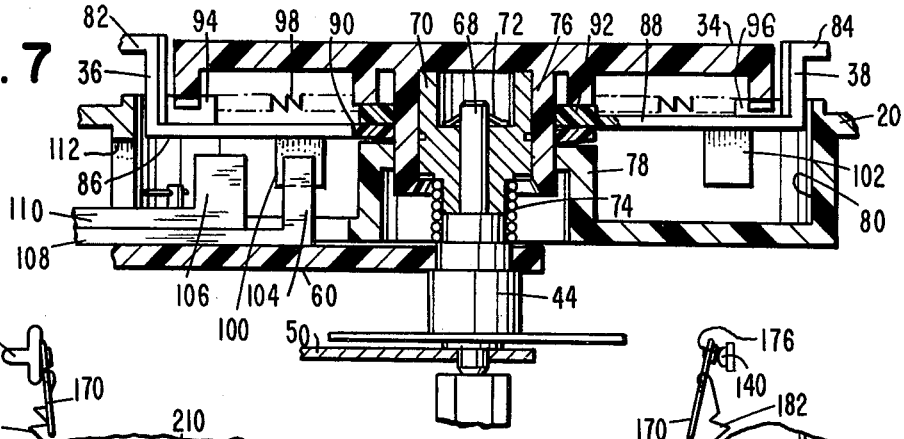
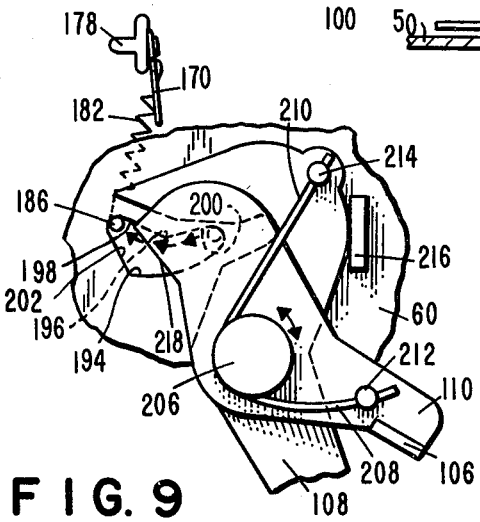
FIG. 9
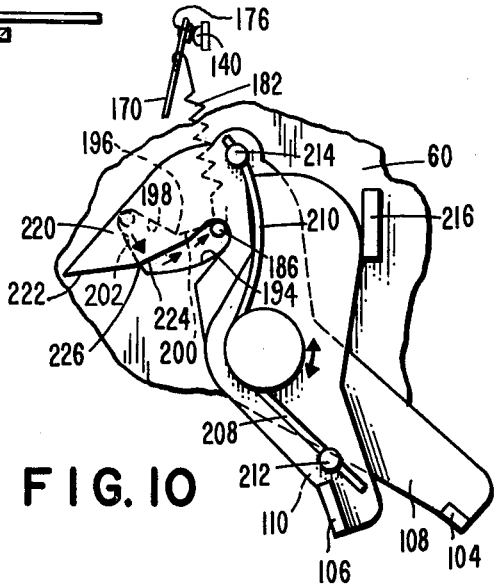
FIG. 10
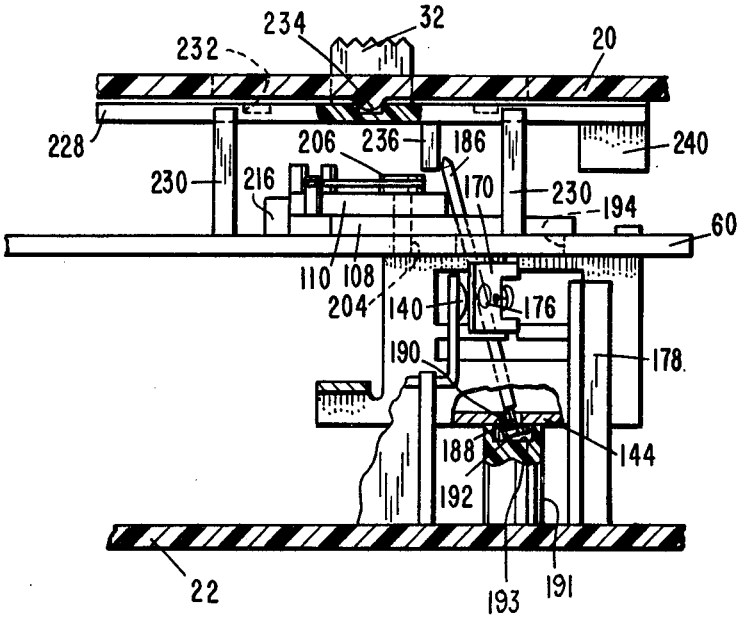
FIG. 8

AUTOMATIC TIMER SWITCH

BACKGROUND OF THE INVENTION

1. Field of the Invention

This invention relates to timing switches, and in particular to switches which are automatically closed at one selected time and opened at another selected time.

2. Description of the Prior Art

The prior art, as exemplified in U.S. Pat. Nos.: 2,890,300, 3,254,166, 3,260,807, 3,271,541, 3,497,645, 3,522,393, 3,548,125, 3,584,166, 3,588,391 and 3,745,107, contains a number of timing switch devices which are opened and closed at selected times. The prior art timing switch devices often include an excessive number of parts, are difficult to assemble, or are excessively expensive. Also, the contacts of the prior art timing switch devices are sometimes subject to chatter, low contact pressure, or other deficiency creating malfunctioning or burning of the contacts of the switch.

U.S. Pat. Nos.: 996,373, 1,578,360, 2,862,083, 2,892,908, 3,200,213, and 3,278,701 disclose a number of prior art snap acting switches.

Also, the prior art contains multiple contact outlet devices such as illustrated in U.S. Pat. Nos.: 2,443,367, 2,869,093, and 3,439,315.

SUMMARY OF THE INVENTION

The invention is summarized in a timer switch including support means, a blade having one end pivoted on the support means with the other end of the blade movable between first and second positions, an operating member, the support means having a guideway for receiving and guiding the operating member, the guideway having one side and first and second ends limiting movement of the operating member along the one side to movement between the first and second ends of the guideway, a spring connecting the free end of the blade to the operating member such as to bias the blade into the first position when the operating member is at the first end of the guideway and to bias the blade into the second position when the operating member is at the second end of the guideway, the spring biasing the operating member against the one side of the guideway, the one side of the guideway having an intermediate point and first and second portions inclined in the direction of the spring bias from the intermediate point to the respective first and second ends of the guideway such that the first and second portions of the one side cam the operating member under the bias of the spring to the first and second ends of the guideway, contact means operated by the blade to open and close at least one circuit, and timing means for alternately moving the operating member from the first end of the guideway past the intermediate point and from the second end of the guideway past the intermediate point.

An object of the invention is to construct a timer switch utilizing a minimum number of parts and which is capable of turning an appliance, light or the like, on and off periodically, such as at selected times every twenty-four-hour period.

Another object of the invention is to provide a timer switch with an over center snap action switch wherein the switching occurs at a faster rate.

It is another object of the invention to eliminate complicated mechanism for effecting manual operation of the switch.

An advantage of this timer is that it employs a dual outlet enabling two appliances to be switched at the same time.

Other objects, advantages and features of the invention will become apparent from the following description taken in conjunction with the accompanying drawings.

BRIEF DESCRIPTION OF THE DRAWINGS

FIG. 2 is an elevational cross section view from the left side of the timer switch of FIG. 1.

FIG. 3 is a front cross section view of the timer switch of FIG. 1.

FIG. 4 is a top cross section view of the timer switch of FIG. 1.

FIG. 5 is a perspective view of one connector member of the timer switch of FIG. 1.

FIG. 6 is a perspective view of a switch contact assembly together with another connector member of the timer switch of FIG. 1.

FIG. 7 is a cross-sectional view of a timer control operating dial mechanism of the timer switch of FIG. 1.

FIG. 8 is a top view of an operating mechanism of the timer switch of FIG. 1 in an "AUTO" position.

FIG. 9 is a front view of a portion of the mechanism of FIG. 8 illustrating opening of the switch contacts.

FIG. 10 is a front view similar to FIG. 9 but illustraing closing of the switch contacts.

DESCRIPTION OF THE PREFERRED EMBODIMENT

Figure 1:
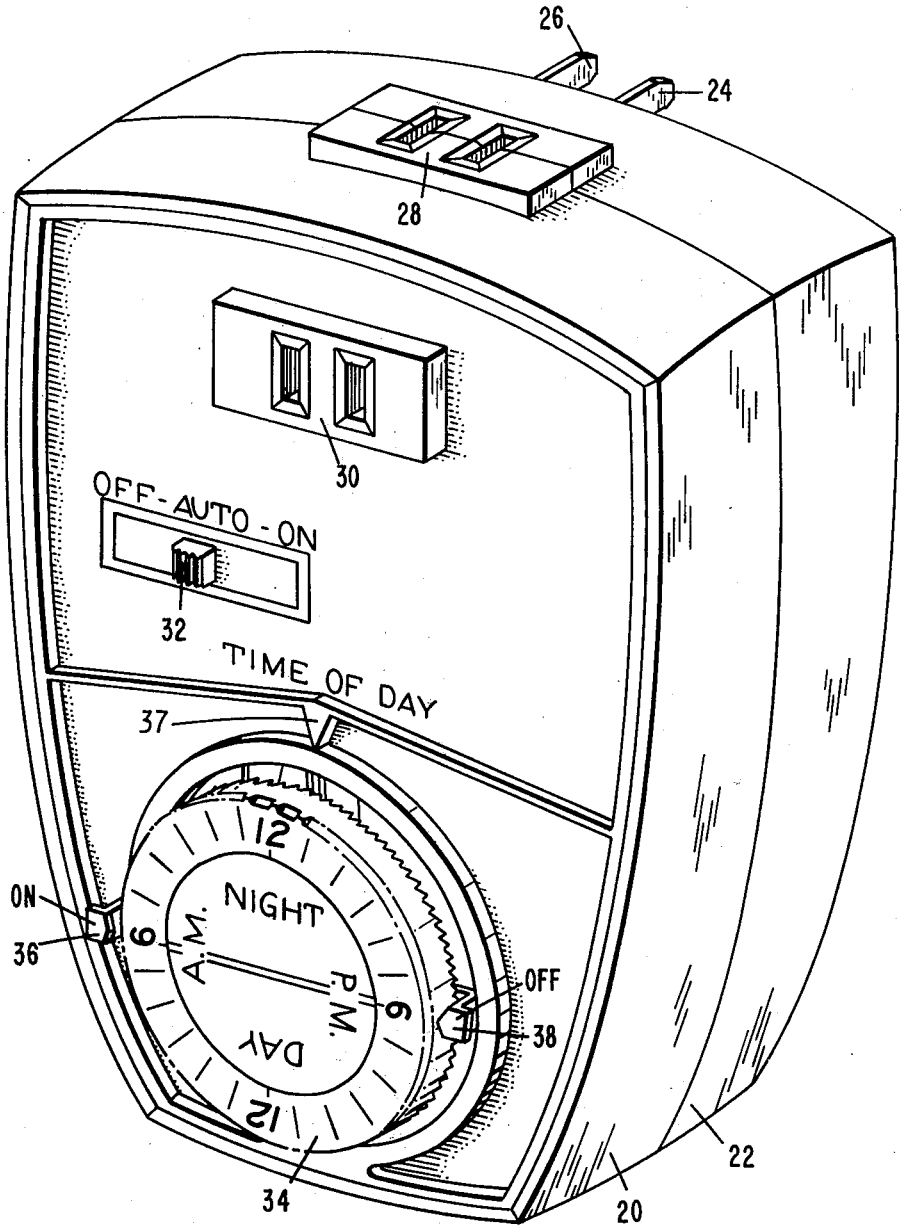
FIG. 1 is a perspective view of a timer switch in accordance with the invention.

As illustrated in FIG. 1, the invention is embodied in a timer switch including a housing formed by front and rear housing portions 20 and 22 formed from a plastic or the like, and male connector prongs 24 and 26 extending from the rear housing portion 22 and adapted to be inserted into a female wall socket. A first pair of female outlet openings 28 are formed in the top of the housing, and a second pair of female outlet openings 30 are formed in the front of the housing. A manual control slide button 3 having OFF, AUTO, and ON positions projects from the front of the housing. A rotating clock dial 34 with an indicator 37 pointing to the time of day carries an ON time selector 36 and an OFF time selector 38. The front and rear housing portions 20 and 22 are secured together by suitable means, such as screws 39, FIG. 4.

Within the housing, as shown in FIG. 2, the timer contains a synchronous electric motor 40 driving a reducing gear train indicated generally at 42, and which, in turn, drives a clock dial shaft 44 at a suitable speed, such as one revolution every 24 hours. Input wires 46 and 48 of the motor 40 are connected to the respective male prongs 24 and 26, see also FIGS. 5 and 6. The motor 40 is suitably mounted on the back of a rear plate 50 supported on posts indicated generally at 52 which are integral with the rear housing half 22. The posts 52 have a large diameter lower portion 54 with a first reduced portion 56 received in locating openings 58 of the rear gear plate 50. The gear plate 50 rests on the shoulder formed by the large section 54 and the first reduced section 56 of the posts 52. As shown in FIG. 4, a front gear plate 60 with openings 52 slid over second reduced portions 64 of the posts 52. Shoulders formed by the first reduced portion 56 and the second reduced portion 64 hold the plate 60 while spring ring nuts 66 secured on the second reduced portions 64 securely hold the front gear plate 60 together with the gear assembly 42 and the rear gear plate 50 on the posts 52. The motor 40 and the gears forming the gear train 42 are conventional motors and gear trains employed in clocking and timer devices. The gear plate 60 is formed from an electrically insulating material such as a rigid plastic while the gear plate 50 may be metal but suitably spaced from the conducting members of the timer.

As shown in FIG. 7, the clock shaft 44 on the last gear of the gear train has a reduced forward section 68 rotatively secured to hub 70 by a spring securing ring 72. A coil spring clutch 74 drivingly connects the shaft 44 to the hub 70 such as to permit clockwise (as viewed from the front) movement of the hub 70 relative to the shaft 44 but to prevent counterclockwise movement of the hub 70 relative to the shaft 44.

The dial 34 has a coaxial tubular mounting portion 76 snugly fit on the hub 70 and rotatable in the bearing portion 78 of front housing portion 20 which has a recess 80 beneath the dial 34. The selectors 36 and 38 have respective indicator tabs 82 and 84 with arm portions 86 and 88 extending beneath the dial 34 in the recess 80 to respective ring portions 90 and 92 rotatively surrounding the tubular portion 76 of the dial 34. The ring portion 90 nearest the bearing portion 78 of the cover 20 is formed into a curvature to form a spring which urges the other ring portion 90 into frictional engagement with the back portion of the cover 34. The arms 86 and 88 have respecive pawl portions 94 and 96 for engaging teeth 98 formed in the back of the outer periphery of the dial 34. The arms 86 and 88 are formed from a suitable material, such as a plastic having resilience and being sufficiently flexible to enable the tab indicators 82 and 84 to be depressed into the recess 80 to disengage the pawl portions 94 and 96 from the teeth 98 to permit the selectors 82 and 84 to be positioned relative to the dial 34 to respective selected times marked on the dial 34. A tab 100 on the arm 86 projects rearwardly in the recess 80 at a first radial distance from the axis from the dial 34 while a tab 102 on the arm 88 projects rearwardly from the arm 88 in the cavity 80 at a second radial distance from the axis of the dial 34. Forward projecting tabs 104 and 106 are on the ends of respective switch operating levers 108 and 110 which extend through an opening 112 formed in the housing portion 24 in the recess 80. The tabs 104 and 106 extend into the respective paths of the tabs 100 and 102 such as to engage thereby during rotation of the dial 34.

The right prong 24, illustrated in FIG. 5, is suitably formed from a stamped sheet of conductive metal and extends through an opening in the rear housing portion 22. A portion 118 of the stamping is bent at a right angle to the prong 24 and is suitably sandwiched between projections 120 and 122, FIG. 4, formed integral with the respective front and rear housing portions 20 and 22 to secure the prong 24 in the housing. A strip or connector portion, indicated genrally at 124 and also integral with the prong 24 has elbows 126 and 128 with respective longitudinal prong receiving and engaging slots 130 and 132 positioned adjacent the right-hand openings of the respective outlets 28 and 30.

As shown in FIGS. 4 and 6, the left prong 126 is similarly formed from a stamping of conductive metal and has a portion 134 which is bent perpendicular to the prong 126 and secured between projections 136 and 138 of the front and rear housing portions 20 and 22, respectively. A contact 140 is attached to the other end of the prong 26. An integral connector assembly indicated generally at 142 has a lower plate portion 144 which has a suitable opening receiving the reduced end 146 of a post 145 with a spring ring 147 fastening the plate portion 144 to the shoulder formed by the post 145 and its reduced end 146. An upper portion 148 of the connector unit 142 is bent into a horizontal plate and has projections 150 for engaging suitable openings of the front gear plate 60. A connector strip, indicated generally at 152, is integral with the unit 142 and bent to form elbows 154 and 156 having suitable longitudinal prong receiving and engaging slots 158 and 160 next to the left-hand openings of the respective outlets 28 and 30.

The portion 148 of the unit 142 has strips 162 and 164 with respective dimples 166 and 168 formed therein pivotally seating the lower end of a contact blade 170 at the upper edge of notches 172 and 174 formed in the front and rear portions of the lower end of the contact blade 170. The bottom edges of the notches 172 and 174 retain the contact blade 170 on the strips 162 and 164. The contact blade 170 has a contact 176 attached to the upper end thereof for mating with the contact 140 of the prong 26. An abutment 178 is formed integral with the rear portion 22 of the housing for limiting leftward movement of the contact blade 170.

The contact blade 170, FIG. 2, has a slot 180 extending from its lower end to just below the contact 176. A spring 182 is secured at its upper end to the upper or free end of contact blade 170 while the spring 182 is secured at its lower end to a reduced section 184 of an elongated operating member or pin 186. As shown in FIG. 8, the pin 186 has a reduced section 188 extending through a hole 190 in the back plate 44 of the unit 142. The reduced section 188 terminates in a head 192. The hole 190 is larger than the diameter of the pin 186 but smaller than the diameter of the head 192. The back plate 144 rests against a post 191 having a cavity 193 containing the head 192. The pin 186 extends forward from the reduced section 184 through a particularly formed guideway or opening 194 in the front gear plate 60. As shown in FIG. 9, opening 194 has an upper side with an intermediate point 196 from which extend portions 198 and 200 which are inclined upwardly toward ends of the opening 194 such that the bias of the spring 182 causes camming of the pin 186 along the respective incline portions 198 and 200 to the respective ends of the opening 194. A camming surface 202 also defined by the opening 194 extends from the left end of the opening 194 downwardly to the right. The intermediate point 196 is spaced below the pivot axis of the blade 170 and approximately in a vertical plane containing the pivot axis of blade 170 such as to be aligned with the plane of the blade 170 when it is midway between abutment 178 and contact 140.

As shown in FIGS. 9 and 10, the levers 108 and 110 are pivotally mounted by a shank 204, FIG. 8, of a pin 206 secured to the front gear plate 60. Springs 208 and 210 are fixed at one end to the head of the pin 206 while the other ends are connected to respective pivot joints 212 and 214 on the respective levers 110 and 108 such as to bias the upper ends of the levers 108 and 110 against an abutment 216 projecting forward from the plate 60. The upper end of the lever 108 has an edge surface portion 218 for engaging the pin 186 and pushing the pin 186 along the surface portion 200 from the right end of the opening 194 past the intermediate point 196 of the upper side of the opening 194. The upper end of the lever 108 is formed into a hood-like portion 220 which has a first lower camming edge 222 for engaging the pin 186 to move the pin 186 into engagement with the camming surface 202. A lower second camming edge 224 extends from point 226 upward to the right inside the hook for camming the pin 186 under force of the spring 182 to the right end of the opening 194.

Figure 11:
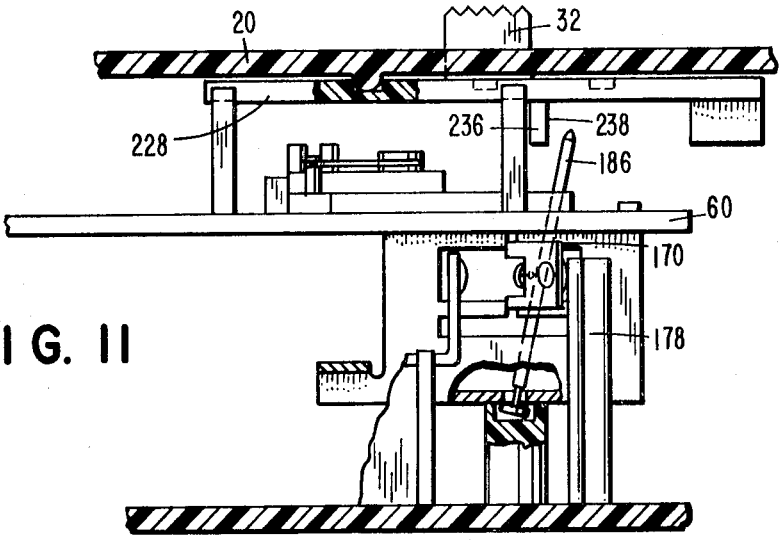
FIG. 11 is a top view similar to FIG. 8 but with a manual control in an "OFF" position.
Figure 12:
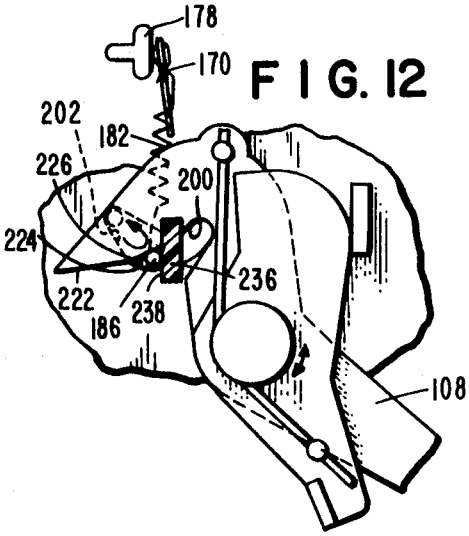
FIG. 12 is a front view similar to FIGS. 8 and 9 but illustrating operation when the manual control is in the OFF position.
Figure 14:
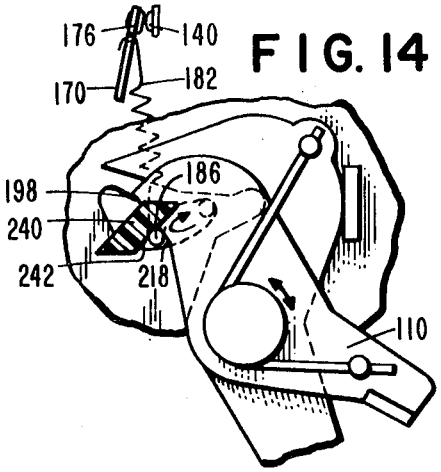
FIG. 14 is a front view similar to FIGS. 8, 9 and 12 but illustrating operation when the manual control is in the ON position.
Figure 13:
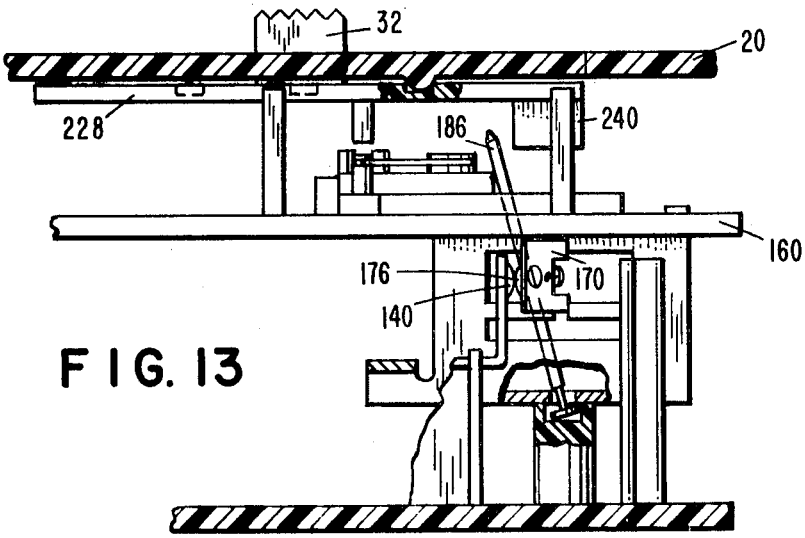
FIG. 13 is a top view similar to FIGS. 8 and 11 but illustrating an "ON" position of the manual control.

The manual control button 32, as illustrated in FIG. 8, extends forward from a slide plate 228 slidably retained in notches formed in the forward ends of support members 230 extending from the plate 60. The slide plate 228 has recesses 232 at three positions spaced therealong for mating with a projection 234 from the front portion 20 of the housing to correspond to the ON, AUTO, and OFF positions of the button 32. The plate 228 has a rearward extending abutment or projection 236 which, when the button 32 is in the OFF position, as shown in FIGS. 11 and 12, has a left surface 238 for engaging the forward end of the pin 186 to move the pin 186 from the right end of the opening 194 past the intermediate point 196 and to prevent the pin 186 from returning from the left end of the opening 194 back past the intermediate point 196. The slide plate 228 also has a rearwardly projecting abutment 240 which, when the button 32 is in the ON position, as shown in FIGS. 13 and 14, has a surface 242 for engaging the pin 186 to move the pin 186 from the right end of the slot 194 past the intermediate point 196 and to prevent the pin 186 from returning past the intermediate point 196. The surface 242 is formed to cooperate with the edge 218 of the lever 110 to cam the pin 186 downward within the opening 194 when the lever 110 is pivoted. The opening 194 is of sufficient size to allow the pin 186 to be cammed downwardly along the surface 242 by the edge 218 when the lever 110 is pivoted counterclockwise.

In operation of the timer switch of FIG. 1, the prongs 24 and 26 are normally inserted into a wall outlet receptacle. One or two appliances may be connected to the timer by inserting their male connectors into the outlet 28 and the outlet 30. The control button 32 may be set in the OFF position to turn and hold the appliances off, may be set into the ON position to continuously energize the appliances, or may be turned to the AUTO position to provide for a timed operation of the appliances. The dial 34 makes one revolution every 24 hours, and when the control button 32 is in the AUTO position, the outlets 28 and 30 are energized at the time selected by the selector 36 and are de-energized at the time selected by the selector 38. As shown in FIG. 7, the selectors 36 and 38 are moved by depressing their respective tabs 82 and 84 to disengage their pawl portions 94 and 96 from the teeth 98 on the back side of the dial 34 and then moving the respective selectors 36 and 38 to their desired times of operation.

More particularly, the plugging-in of the prongs 24 and 26 into the wall outlet receptacle directly connects the connector strip 124, FIGS. 3 and 5, to one side of the power line connected to the wall receptacle while the second prong 26 is energized by the other side of the power line connected to the wall receptacle. The motor 40, FIG. 2, within the housing is energized by its leads 46 and 48 to drive the gear train 42 rotating the shaft 44 clockwise, as viewed from the front. When the ON selector 36 approaches the time of day indicator 37 on the front of the timer of FIG. 1, the tab 100, FIG. 7, engages the projection 104 on the lever 108 causing the lever 108 to pivot counterclockwise about the pin 206. As shown in FIG. 10, the camming surface 222 on the hook-like portion 220 of the lever 108 engages and moves the forward end of the pin 186 against the camming surface 202 of the opening 194. The forward end of the pin 186 is cammed downward by cooperation of the camming surfaces 202 and 222 until the lever 108 has pivoted sufficiently to move the pin 186 past the point 226 whereupon the force of the spring 182 causes the camming of the pin 186 on the surface 224 to the right end of the opening 194. As shown in FIGS. 3 and 9, when the pin 186 is in the left end of the opening 194, the spring 182 is to the left of the pivot point of the contact blade 170; thus, the contact arm 170 is held by the tension force of the spring 182 against the abutment 182 holding the contact 176 on the blade 170 disengaged or separated from the contact 140 on the prong 26. When the pin 86 moves past the center point 196 and slides toward the right end of the slot 194, the spring 182 passes through the slot 180 within the blade 170 past the pivot point of the blade 180 to the right side of the contact blade 170; thus, the force of the spring 182 pivots the contact blade 170 engaging the contact 176 with the contact 140 when the pin 186 is moved to the right end of the slot 194. A circuit is completed from the prong 26 through the contact 140, the contact 176, the contact blade 170, and the connector unit 142 and the connector strip 152 to the connector elbows 154 and 156 behind the respective left openings of the receptacle outlets 28 and 32 to energize the outlets 28 and 30.

When the off selector 38 approaches the time of day indicator 37, FIG. 1, of the timer switch, the tab 102 on the arm 88 engages the projection 106 on the lever 110 to pivot the lever 110 counterclockwise about the pin 206 as shown in FIG. 9. The surface 218 engages the forward end of the pin 186 sliding the pin 186 down along the edge surface portion 200 until it passes the intermediate point 196 whereupon the force of the spring 182 causes the camming of the pin 186 down the incline surface 198 from the intermediate point 196 to the left end of the slot 194. As the pin slides from the intermediate point 196 to the left end of the slot 194, the spring passes to the left of the pivot point of the contact blade 170 bringing about pivotal movement of the contact blade 170 in a counterclockwise direction to disengage the contacts 176 and 140 thereby bringing about de-energization of the outlets 28 and 30.

When the manual control button 3 is moved from the AUTO position, as illustrated in FIG. 8, to the OFF position, as illustrated in FIGS. 11 and 12, the surface 238 of the abutment 236 of the slide 228 engages the forward end of the pin 186, if the pin 186 is in the right end of the opening 194, causing the pin 186 to slide along the incline surface 200 past the intermediate point 196 thereby bringing about disengagement of the contacts 140 and 176 by the movement of the pin 186 along the incline edge 190 by the force of the spring 182. Thereafter, the projection 236 prevents the pin 186 from sliding along the surface 200 past the intermediate point 196 as the lever 108 is pivoted; thus preventing the energization of the outlets 28 and 30 even when the on selector 36 passes the time of day indication. The pin 186 slides back to the left end of the opening 196 after the lever 108 is released by advancement of the tab 100, FIG. 7, to allow the spring 210, FIG. 9, to return the lever 108 against the abutment 216.

Similarly, when the manual control button 32 is moved to the ON position, as shown in FIGS. 13 and 14, the surface 242 of the abutment 240 engages the pin 186 sliding the pin 186 along the inclined edge 198 of the opening 194 past the intermediate 196 thereby bringing about engagement of the contacts 140 and 176 as the pin 186 is cammed by the incline surface edge 200 under the force of the spring 182. Thereafter, the pin 186 is prevented from moving to the left of the intermediate point 196 by the surface 242 of the projection 240. Movement of the lever 110 by the off selector 38 causes the camming surfaces 218 and 242 to cooperate to move the pin 186 downward along the surface 242 within the slot 194 but not to the left of the blade 170; thereby the contacts 140 and 176 are held together and the outlets 28 and 30 remain energized.

It is particularly advantageous that the contact blade 170 be switched as the pin 186 is being moved under the force of the spring along camming surfaces. The movement of the pin 186 along the camming surfaces 198, 200 or 224 is rapid, resulting in the spring 182 quickly passing through the pivot point of the contact blade 170 to bring about rapid engagement and disengagement of the contacts 140 and 176. Rapid engagement and disengagement of the contacts results in longer life of the contacts as well as more reliability in making a completed circuit. Further, the force of the spring 182 increases as it is moved from the right end of the opening 194 toward the intermediate point 196, either on edge 200 or the surface 242, thereby maintaining more force between the contacts 176 and 140. The force between the contacts 140 and 176 brings about a better conductivity condition therebetween increasing reliability and longevity.

It is also noted that the particular construction of the timer switch is relatively simple and easy. The energizing path for the right opening of the outlets 22 and 30 is a single, integral unit 124 which may be stamped from a conductive metal while the energizing facilities for the left openings of the outlets 28 and 30 is formed by three pieces, namely, the prong 28, the connector assembly unit 142, and the contact blade 170. The elements are easily assembled and secured within the housing halves 20 and 22.

Since many modifications, variations, and changes in detail may be made to the presently described embodiment, it is intended that all matter in the foregoing description and shown in the accompanying drawings be interpreted as illustrative and not in a limiting sense.

What is claimed is:

1. A timer switch comprising support means, a blade having one end pivoted on the support means with the other end of the blade movable between first and second positions, an operating member, said support means having a guideway for receiving and guiding the operating member, said guideway having one side and first and second ends limiting movement of the operating member along the one side to movement between the first and second ends of the guideway, a spring connecting the free end of the blade to the operating member such as to bias the blade into the first position when the operating member is at the first end of the guideway and to bias the blade into the second position when the operating member is at the second end of the guideway, said spring biasing the operating member against the one side of the guideway, said one side of the guideway having an intermediate point and first and second portions inclined in the direction of the spring bias from the intermediate point to the respective first and second ends of the guideway such that the first and second portions of the one side cam the operating member under the bias of the spring to the respective first and second ends of the guideway, contact means operated by the blade to open the close at least one circuit, and timing means for alternately moving the operating member from the first end of the guideway past the intermediate point and from the second end of the guideway past the intermediate point.

2. A timer switch as claimed in claim 1 wherein the operating member is an elongated member pivotally mounted at one end on the support means, the other end of the elongated member being guided by the guideway.

3. A timer switch as claimed in claim 2 wherein the support includes a plate portion with an opening therein; the elongated member is a pin transverse to a plane defined by the movement of the blade, said pin having a head on the one end larger than the opening and a reduced section extending through the opening to form a shoulder on the pin at the edge of the reduced section to engage the plate portion on the opposite side from the head.

4. A timer switch as claimed in claim 1 wherein the spring is a tension spring urging the blade against its pivot point, and the intermediate point of the guideway is spaced from the pivot point of the blade opposite to the free end of the blade and in alignment with the blade when the blade is midway between the first and second positions.

5. A timer switch as claimed in claim 1 wherein the timing means includes a synchronous motor, a gear train operated by the synchronous motor, a clock dial rotated by the gear train, first and second selectors selectively positionable about the clock dial, a first lever to be engaged at one end by the first selector, a second lever to be engaged at one end by the second selector, means biasing the first and second levers into unpivoted positions, said levers having means formed on the other ends thereof for engaging the operating member to move the operating member from the respective first and second ends of the guideway past the intermediate point.

6. A timer switch as claimed in claim 5 including a manual control having first, second and third positions, said manual control having a first abutment for moving the operating member from the first end of the guideway past the intermediate point and for preventing return of the operating member from the second end of the guideway past the intermediate point when the manual control is in its first position, said manual control having a second abutment for moving the operating member from the second end of the guideway past the intermediate point and for preventing return of the operating member from the first end of the guideway past the intermediate point when the manual control is in its third position, and said first and second abutments positioned to allow movement of the operating member between the first and second ends of the guideway when the manual control is in its second position.

7. A timer switch as claimed in claim 6 wherein the first and second levers have respective first and second camming surfaces formed on their other ends for engaging the operating member to move the operating member in respective opposite directions from the respective ends of the guideway past the intermediate point; and the first and second abutments have third and fourth camming surfaces, respectively, for engaging the operating member and for cooperating with the respective first and second camming surfaces when the manual control is its respective first and third positions to allow movement of the operating member away from the one side of the guideway to permit uninhibited movement of the first and second levers.

8. A timer switch as claimed in claim 7 wherein the guideway has a fifth camming surface extending from the first end of the guideway at an arcuate angle with the first portion of the one side for cooperating with the third camming surface on the first lever to cam the operating member toward the intermediate point of the one side.

said first lever having a sixth camming surface extending from the third camming surface to cam the operating member under the bias of the spring toward the second end of the guideway past the intermediate point when the first lever is in its pivoted position.

9. A timer switch comprising support means, a blade having one end pivoted on the support means with the other end of the blade movable between first and second positions, an elongated operating member pivoted at one end, said support means having a guideway receiving and guiding the other end of the elongated operating member between first and second positions, a spring connecting the free end of the blade to a point on the operating member spaced from its one end such as to bias the blade into its first position when the operating member is in its first position and to bias the blade into its second position when the operating member is in its second position, contact means operated by the blade to open and close at least one circuit, automatic timing means for alternately engaging and pushing the other end of the operating member between its first and second positions, and a manual control having first and second abutments and having first, second and third positions, said first abutment positioned to engage the other end of the operating member to prevent movement of the operating member to its first position when the manual control is in its first position, said second abutment positioned to engage the operating member to prevent movement of the other end of the operating member to its second position when the manual control is in its third position, and said first and second abutments allowing free movement of the operating member when the control is in its second position.

10. A timer switch as claimed in claim 9 wherein the manual control includes a slide plate, and a button extending from the slide plate, said first and second abutments also extending from the slide plate, and the support means includes means slidable supporting the slide plate.

11. A timer switch as claimed in claim 10 wherein the support means and the slide plate have cooperating detent and projection means to retain the slide plate in the respective first, second and third positions of the manual control.

12. A timer switch comprising support means a blade having one end pivoted on the support means with the other end of the blade movable between first and second positions;

an operating member movable between first and second positions;

a spring connecting the free end of the blade to the operating member such as to bias the blade into its first position when the operating member is in its first position and to bias the blade into its second position when the operating member is in its second position; contact means operated by the blade to open and close at least one circuit;

automatic timing means for alternately moving the operating member between its first and second positions;

said timing means including a synchronous motor, a gear train operated by the synchronous motor, a clock dial rotated by the gear train, first and second selectors selectively positionable about the clock dial, first and second levers pivotally mounted on the support means and having first ends positioned to be engaged and pivoted through arcs by the respective first and second selectors, and means biasing the first and second levers into unpivoted positions, said first and second levers having respective means formed on the other ends thereof for engaging the operating member to move the operating member to its respective first and second positions;

a manual control having first and second abutments and having first, second and third positions, said first abutment positioned to engage the operating member to prevent movement of the operating member to its first position when the manual control is in its first position, said second abutment positioned to engage the operating member to prevent movement of the operating member to its second position when the manual control is in its third position, and said first and second abutments allowing free movement of the operating member when the manual control is in its second position;

said manual control including a slide plate, and a button extending from the slide plate, said first and second abutments also extending from the slide plate, said support means including means slidably supporting the slide plate; and said support means and said slide plate having cooperating detent and projection means to retain the slide plate in the respective first, second and third positions of the manual control.

13. A timer switch as claimed in claim 12 wherein the first and second levers have respective first and second camming surfaces formed on their other ends for engaging the operating member to move the operating member in respective opposite directions to its first and second positions; and the first and second abutments have third and fourth camming surfaces, respectively, for engaging the operating member and for cooperating with the respective first and second camming surfaces when the manual control is in its respective first and third positions to permit uninhibited movement of the first and second levers.

14. A timer switch comprising a housing having a pair of prong receiving openings and a pair of outlet openings;

a first integral conductive member having a prong extending through one of the pair of prong openings in the housing and having prong engaging means disposed adjacent one of the pair of outlet openings;

a second integral member having a prong extending through the other of the pair of prong receiving openings in the housing;

a first contact mounted on the second integral member;

a third integral member including a pivot seat and prong engaging means disposed adjacent the other of the outlet openings;

a contact blade pivotally mounted on the pivot seat of the third integral member;

a second contact mounted on the contact blade; and timing means for pivoting the contact blade between first and second positions such that the first and second contacts are engaged in the first position and such that the first and second contacts are disengaged in the second position;

said timing means including a synchronous motor, a gear train operated by the synchronous motor, a clock dial rotated by the gear train, first and second selectors selectively positionable about the clock dial, first and second levers pivotally mounted on the support means and having first ends positioned to be engaged and pivoted through respective arcs by the respective first and second selectors, means biasing the first and second levers into unpivoted positions, an operating member movable between first and second positions, and a spring connecting the free end of the blade to the operating member such as to bias the contact blade into its first position when the operating is in its first position and to bias the contact blade into its second position when the operating member is in its second position, and said first and second levers having respective means formed on the other ends thereof for engaging the operating member to move the operating member to its respective first and second positions.

15. A timer switch comprising a housing having a pair of prong receiving openings and a pair of outlet openings;

a first integral conductive member having a prong extending through one of the pair of prong openings in the housing and having prong engaging means disposed adjacent one of the pair of outlet openings;

a second integral member having a prong extending through the other of the pair of prong receiving openings in the housing;

a first contact mounted on the second integral member;

a third integral member including a pivot seat and prong engaging means disposed adjacent the other of the outlet openings;

a contact blade pivotally mounted on the pivot seat of the third integral member;

a second contact mounted on the contact blade; and timing means for pivoting the contact blade between first and second positions such that the first and second contacts are engaged in the first position and such that the first and second contacts are disengaged in the second position;

said housing including front and back housing portions having respective projections for mounting the first, second and third integral members in the housing, and means securing the front and back housing portions together.

* * * * *